US009896240B2

(12) United States Patent
Klann

(10) Patent No.: US 9,896,240 B2
(45) Date of Patent: Feb. 20, 2018

(54) HUMIDITY CONTROL PACKAGE

(71) Applicant: LaserSharp FlexPak Services, LLC, St. Paul, MN (US)

(72) Inventor: Kenneth Klann, Grant, MN (US)

(73) Assignee: Lasersharp Flexpak Services, LLC, Vadnais Heights, MN (US)

( * ) Notice: Subject to any disclaimer, the term of this patent is extended or adjusted under 35 U.S.C. 154(b) by 0 days.

(21) Appl. No.: 15/359,373

(22) Filed: Nov. 22, 2016

(65) Prior Publication Data

US 2017/0320633 A1 Nov. 9, 2017

Related U.S. Application Data

(60) Provisional application No. 62/331,372, filed on May 3, 2016.

(51) Int. Cl.

| | |
|---|---|
| ***B65D 30/24*** | (2006.01) |
| ***B65D 85/12*** | (2006.01) |
| ***B65D 30/08*** | (2006.01) |
| ***B65D 81/26*** | (2006.01) |

(52) U.S. Cl.

CPC ..... *B65D 31/14* (2013.01); *B65D 31/02* (2013.01); *B65D 31/04* (2013.01); *B65D 81/264* (2013.01); *B65D 85/12* (2013.01)

(58) Field of Classification Search

CPC ..... A24F 25/02; A24F 25/00; A24F 23/00; B65D 31/14; B65D 31/02; B65D 81/264; B65D 85/12

USPC ..... 206/204, 242; 229/909; 312/31, 31.1

See application file for complete search history.

(56) References Cited

U.S. PATENT DOCUMENTS

2007/0184238 A1* 8/2007 Hockaday ..... B32B 7/00 428/98

* cited by examiner

*Primary Examiner* — Andrew Perreault

(74) *Attorney, Agent, or Firm* — Law Office of Scott C Harris, Inc

(57) ABSTRACT

A humidity controlled package that uses a humidity sensitive valve that opens and closes an opening to control a humidity in the package. The package has a package holding area inside the package. The humidity level in the package controls the valve to open to allow air flow between an inside of the valve and an outside of the valve, and close to prevent air flow between the inside and outside of the valve. At least part of the valve is in the package. In one embodiment, the package is vented when the humidity value gets higher than a setpoint. In another embodiment, a sachet of dessicant is opened by the humidity level.

8 Claims, 6 Drawing Sheets

HUMIDITY CONTROL PACKAGE

This application claims priority from Provisional application No. 62/331,372, filed May 3, 2016, the entire contents of which are herewith incorporated by reference.

BACKGROUND

A device made of a moisture sensitive film or material laminated to a non-moisture-sensitive film or material can be used as an economical way to control humidity in a sealed package or confined space by reacting to the humidity level in the package and opening or closing a vent to outside air or to a desiccant sachet or moisture sink. As described herein, the level of humidity causes the valve to mechanically change shape and thus open or close an orifice. The control of humidity can extend the shelf life of packaged products and optimize the moisture content of products such as perishable foods or produce, medical products, electronic components, fine tobaccos and many other applications.

Targeting an optimal humidity level in a sealed package will become more critical with the increasing trend to design packaging to restrict air exchange to the minimum required Oxygen Transmission Rate (OTR).

For example, while packages restricting the OTR to reduce respiration rates and extend the shelf life of perishable foods are commonly used today, these packages also undesirably restrict the water vapor from venting out of the package.

Currently there is no attempt to control humidity independently from OTR in an OTR package for perishable foods or produce. Current packaging designs that address the issue of high humidity do so by creating large perforations "Macro perforations" or openings in the package. The inventor recognizes that perforations of this type cause the OTR to vent to the outside air. As such, this can negate any benefits of restricting OTR to extend shelf life of some perishable foods like produce and account for loss of weight of the produce being packaged. The large perforations also allows higher respiration rates and excess humidity to continually escape from the package, causing the humidity to go below the optimal level or undesirably drying out the perishable food.

Distributors and grocery stores address this loss of moisture and weight by controlling the atmospheric humidity, commonly by the use of water misters spaying water on the produce packaging. Water misters often create free standing water on the produce which in turn can generate water damage and or microbiological growth. Anti-fog films are used in produce packaging to prevent the appearance of condensation but do not prevent condensation itself or control the level of humidity.

The inventor believes that a buildup of moisture in a restricted OTR package will cause water damage due to condensation and microbiological growth. This may become the leading failure mode in packaged produce.

Also, in products measured by weight, weight reduction due to drying can effect the product's sale ability and accuracy of the product marking. By preventing the reduction of weight by keeping a constant humidity, the embodiments can avoid this issue.

The present application describes an OTR restriction and humidity control valve and package, and techniques for using these. These embodiments are well suited as a combined effort to extend the shelf life of perishable produce. Active humidity control will only be in effect under the conditions that it is needed.

DETAILED DESCRIPTION

Figure 8:
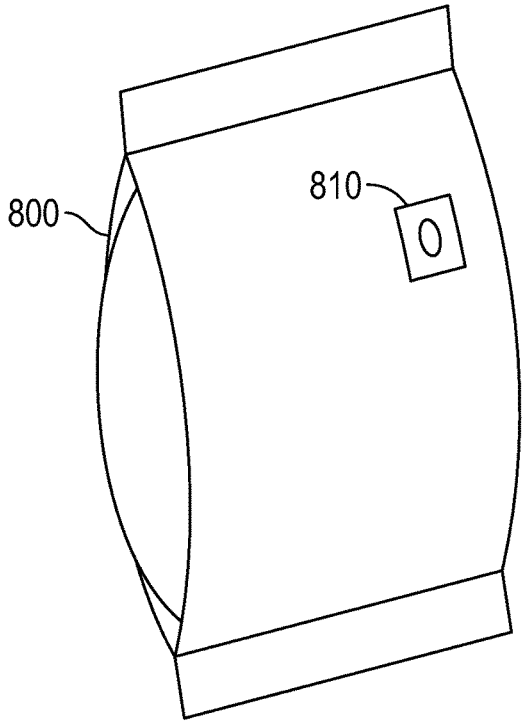
FIG. 8 shows the humidity control valve attached to the inside of the package film such as in FIGS. 3*a* and 3B.

FIG. 8 shows a film package 800. This or any other kind of package can incorporate the humidity valve and techniques disclosed in the embodiments. In FIG. 8, a humidity control valve 810 is shown attached to the inside of the package film. The valve can be that shown in any of the embodiments of the present application. As described herein, this humidity control valve of this embodiment selectively opens the inside of the package to the outside air when the humidity in the package gets higher than a set level. The package OTR is designed to keep the humidity controlled when the valve is not active (open). When the humidity inside gets too high, as described herein, the OTR restriction is temporarily lifted and the valve is opened to allow air to be exchanged.

This embodiment can use the valve of the figures, e.g., 3A-3B, as described herein.

Figure 4A:
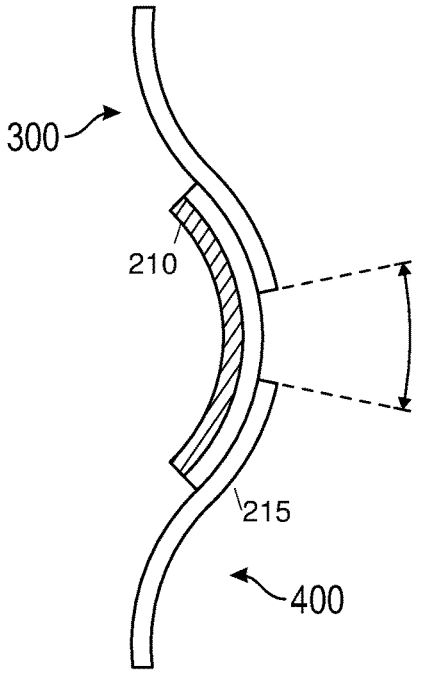
FIGS. 4A and 4B show opening and closing a sachet of desiccant.
Figure 4B:
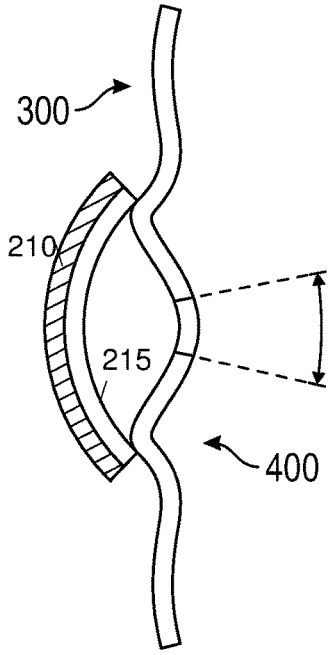
Figure 4C:
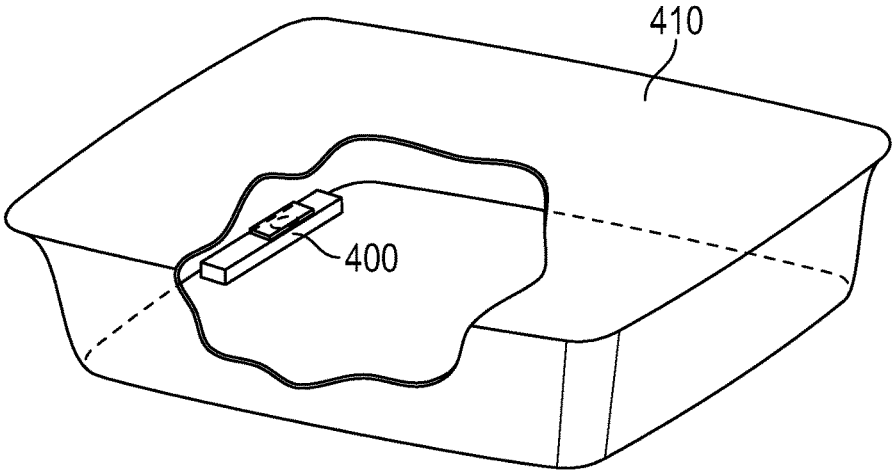
FIG. 4C shows how the desiccant sachet can be used within a typical package.

The humidity control valve of FIG. 4C is an alternative that does not require lifting the OTR restriction when the humidity increases. In FIG. 4C, the package 410 includes an interior humidity control valve 400. The valve 400 covers will and selectively allows air exchange with a sachet 401 which contains desiccant material 402.

The embodiment of FIG. 4C can use, for example, the humidity control valve shown in FIGS. 4A and 4B.

In FIG. 4C, the container is shown with the valve 400, and a container 401 of desiccant 402. The valve 400 is closed when the humidity is less than a set point. The valve opens when the humidity gets too high, allowing the desiccant to absorb some of the humidity. In this embodiment, the package OTR remains unaffected when the valve opens to adjust humidity.

Embodiments use packaging film materials for creating a humidity control valve. Preferred materials can include polyester (PET) and nylon, although there are a variety of other materials that are suitable. Nylon's sensitivity to humidity and its tendency to swell with increased moisture content can make this a particularly preferred material. The moisture content of nylon is proportional to the humidity of the air to which the nylon is exposed.

According to a table published by BASF, moisture content of PA 66 (Nylon) under different Relative Humidity (RH) conditions increases from:

1.0% at 30% RH
2.5% at 50% RH
3.6% at 62% RH
8.5% at 100% RH

Nylon swells in a near linear proportion to its moisture content. According to Underwriters Laboratories' Prospector Knowledge Center, PA 66 increases in dimension in a near linear manner from 0% at 0% moisture content to 2% at 7% moisture content. Therefore, nylon grows or swells in a linear proportion to the humidity of the air in contact with the nylon.

In all the embodiments, the valve opens and closes an orifice. The orifice can be between the inside of the package and the outside of the package, or between the inside of the package and a sachet of dessicant in another embodiment.

Figure 1A:
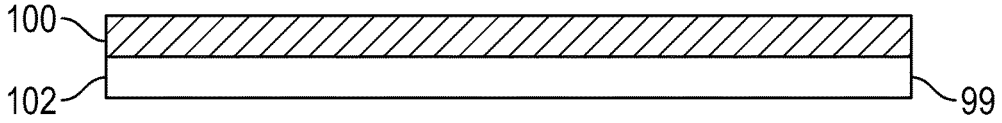
FIGS. 1A-1C show the humidity control valve of an embodiment, at different humidity levels.
Figure 1B:
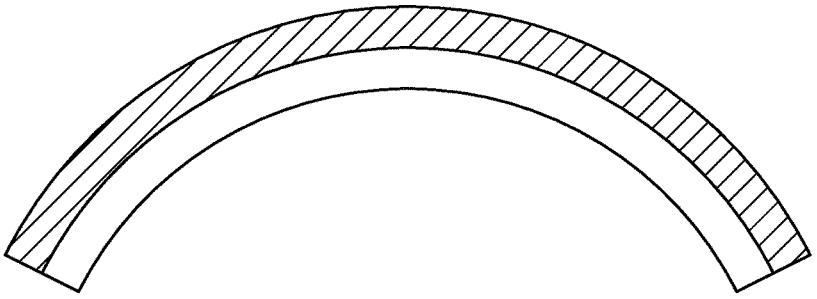
Figure 1C:
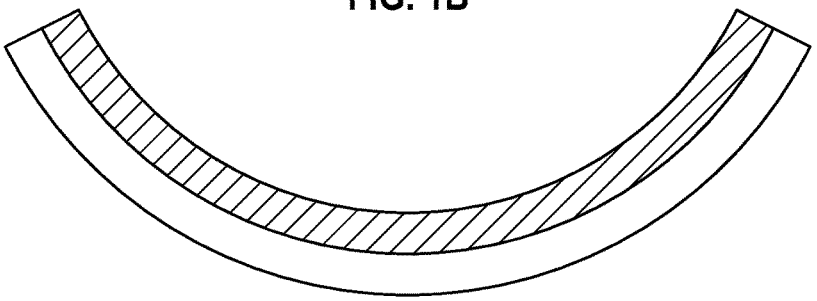

FIGS. 1A-1C illustrate an embodiment using two layers of material forming a stack 99, showing how the shape of the stack changes with humidity. In FIG. 1A, there is a laminated material including a first layer 100 of moisture sensitive material such as nylon, laminated to a second material 102 of a non-moisture sensitive film such as PET. FIG. 1A shows the condition of the stack 99 at a neutral humidity set point, which is the point of humidity for which the package is intended. At this neutral humidity set point, the laminated material stays flat. The neutral or flat state of this laminated film structure occurs at the humidity level and or the moisture content of the nylon when the two films are laminated and will be defined here as the set point shown in FIG. 1A. Above this level of humidity set point, the nylon will swell and the film structure will curl with the nylon side becoming convex as shown in FIG. 1B. Below this set point the nylon will shrink and that side having the nylon will become concave as shown in FIG. 1C.

Prior to lamination to the PET film, the nylon film is specified to a certain film thickness in one embodiment. The nylon film is then pretreated to absorb a specified amount of water to match a specific desired humidity level, in one embodiment. For example, if the "set" humidity level is 50%, then the nylon film 100 is pretreated to 50% before laminating. Therefore a range of humidity set points can be achieved by adjusting the conditions during lamination to match the target humidity of each specific product such as perishable foods or produce. Small pieces of the PET-nylon film can then be cut and used as the humidity control valve, for attachment to the packaging film as in FIG. 8 or to a desiccant sachet as in FIG. 4C.

In another embodiment, however, the nylon is not pretreated to a specific humidity to determine the set point of the valve. In this embodiment, the nylon at 0% moisture content/0% humidity is stretched and then laminated to the PET to determine a set point of 0-100% relative humidity. The critical factor in this embodiment is the percentage from 0% humidity that the nylon is deformed, whether due to swelling or mechanically stretching or a combination of both.

When the humidity increases to a level above the set point, the nylon 100 swells, causing its length to increase. This leads to a difference in length of the nylon layer 100 relative to the PET layer 102. This length difference results in a deflection of the laminated bi-layer structure as shown in FIG. 1B. The embodiments take advantage of this "curl" to open an airway when the curl is caused by excess humidity.

Figure 2A:
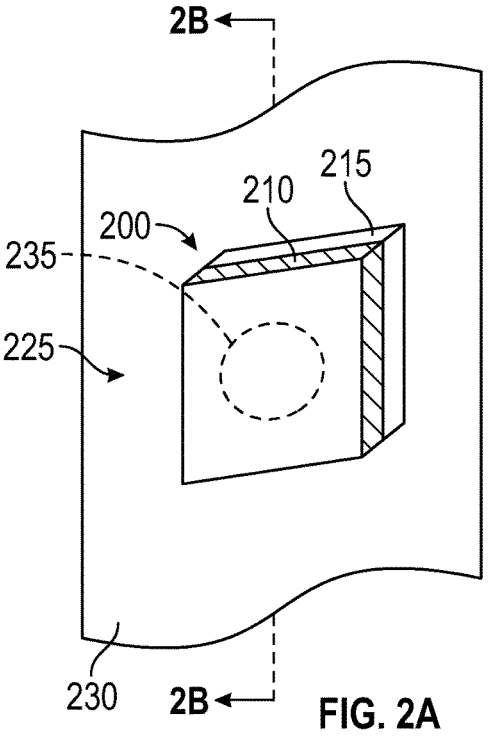
FIG. 2A shows the humidity control valve on a sachet or package film.
Figure 2B:
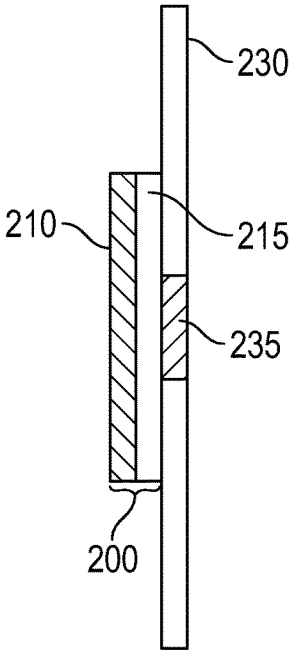
FIG. 2B shows a cross-section along the line A-A in FIG. 2A.

FIG. 2A-2B shows an embodiment which can be used for humidity set points that are relatively higher than the outside or ambient air. A small piece of laminated PET-Nylon valve 200 as in FIG. 1 is used as a humidity control valve. FIG. 2A shows this attached to the inside surface 225 of a package film 230. The valve 200 is exposed to the sealed package environment, to provide humidity control to that environment. The valve covers a hole or slit 235 in that sealed package. The nylon side 210 of the humidity control valve is preferably exposed to the interior volume of the package to "detect" the humidity in the package. The PET side 215 of the valve forms a seal around the opening or slit 235 which is typically made in the packaging film centered within the Humidity Control Valve.

FIG. 2B shows a cross section along the line A-A in FIG. 2A, showing how the valve covers the opening 235.

Figure 3A:
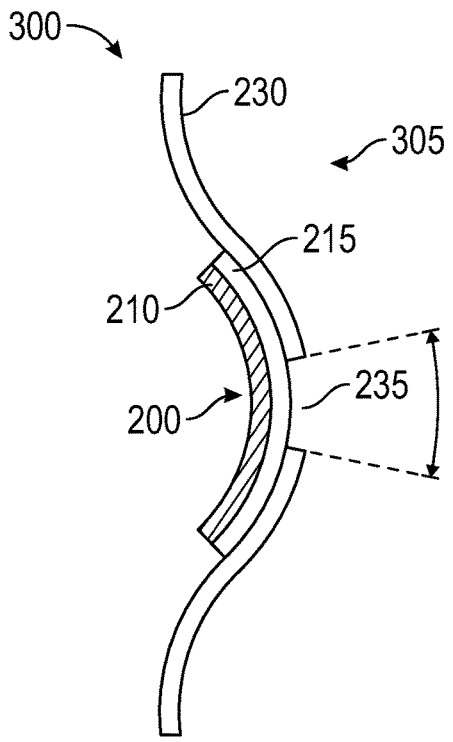
FIG. 3A shows the humidity control valve in its closed position and FIG. 3B shows the humidity control valve in its open position, in an embodiment where the contents of the package material being vented to the environment.

If the humidity is lower than the set point, the structure will become concave from the nylon's perspective. The structure in the concave state forms a seal when concave as shown in FIG. 3*a* and FIG. 4*a*. The seal also is maintained when the valve is flat, meaning that the humidity is "at" the set point.

Figure 3B:
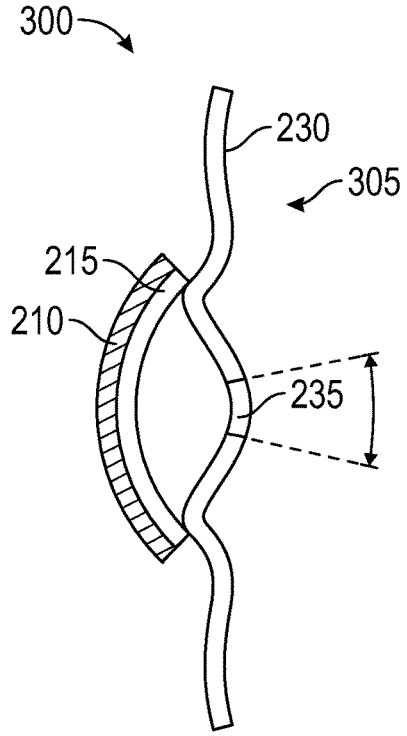

If the humidity is higher than the set point, the structure will be convex from the nylon expanding and the seal will be broken as shown in FIG. 3*b* and FIG. 4*b*. This causes the inside of the package to come into contact with the breach 235

The valve can be adhered by adhesive to packaging film in one embodiment. This can use films which are common in the flexible packaging industry. The packaging film typically roughly ranges from 13 to 130 microns (0.0005" to 0.005") in thickness.

In the case where the humidity control valve is attached to the packaging film as in FIGS. 3A-3B, when the seal is broken, humid air from inside the package is exchanged with the air outside of the package. Assuming the air outside of the package is less humid than the air inside the package, the exchange of air from inside and outside of the package will eventually bring the humidity to the set point of the valve structure 200. When the humidity inside the package reaches a point at or below the set point, the valve straightens, and the seal is reformed. A steady state for humidity is maintained at the designed set point as this cycle continues.

In the case where the humidity control valve is attached to a desiccant sachet or moisture sink as in FIGS. 4A-4D, when the seal is broken water vapor from inside the package 300 is absorbed and contained in the desiccant or moisture sink 400, thus lowering the humidity within the package. When the humidity within the package reaches a point at or below the set point, the seal is reformed. A steady state for humidity is maintained at the designed set point as this cycle continues until the capacity of the desiccant or moisture sink has been reached.

The desiccant or moisture sink 400 within sachet should be sealed from to the humid air within the package when the humidity control valve is sealed. The sachet should therefore be constructed from a barrier film that prevents moisture from being absorbed below the set point or open state. The humidity control valve, when acting on a desiccant sachet, will not affect the exchange of air from the interior and exterior of the package and therefore not interfere with the specified OTR of the package.

Figure 5:
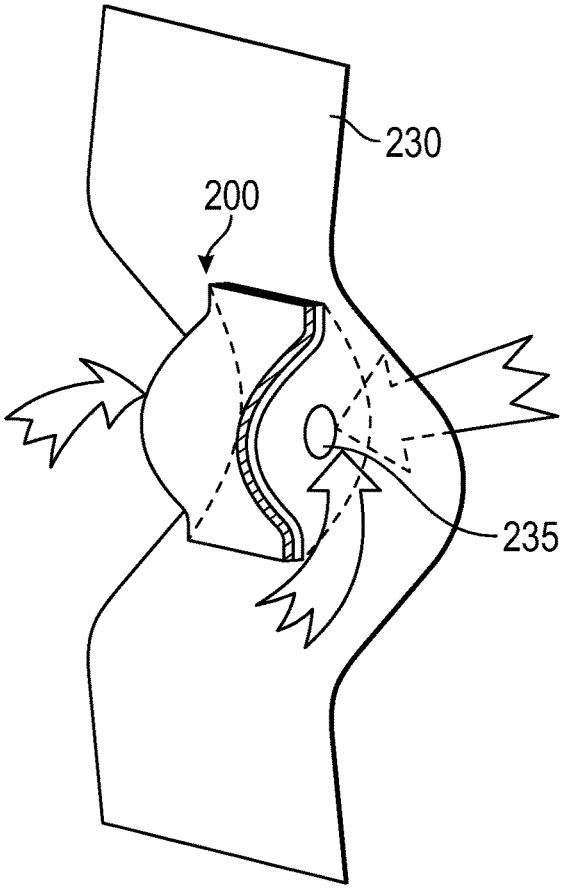
FIG. 5 shows the package film with the vent using an embodiment.

FIG. 5 illustrates how the convexed nylon/PET laminate 200 bends away from the packaging material 230 when the inside humidity gets higher than the set point, thus removing the PET layer from sealing the opening 230 and allowing outside air into the package.

Alternatively for humidity set points that are relatively lower than the outside or ambient air, a small piece of laminated PET-Nylon film or humidity control valve can be attached to the outside surface of a package film.

Figure 4D:
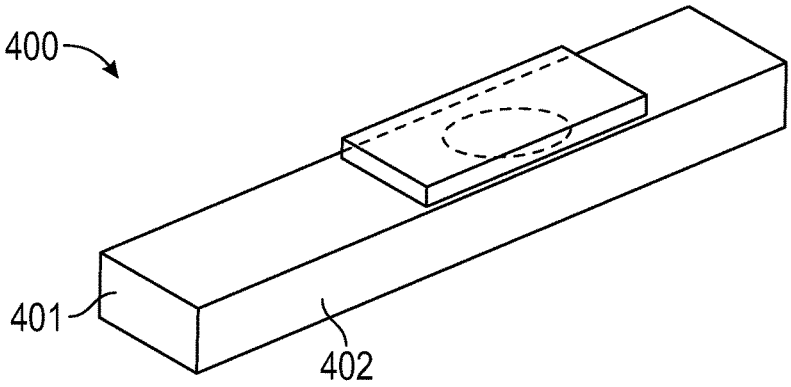
FIG. 4D shows a detail of the desiccant sachet
Figure 4E:
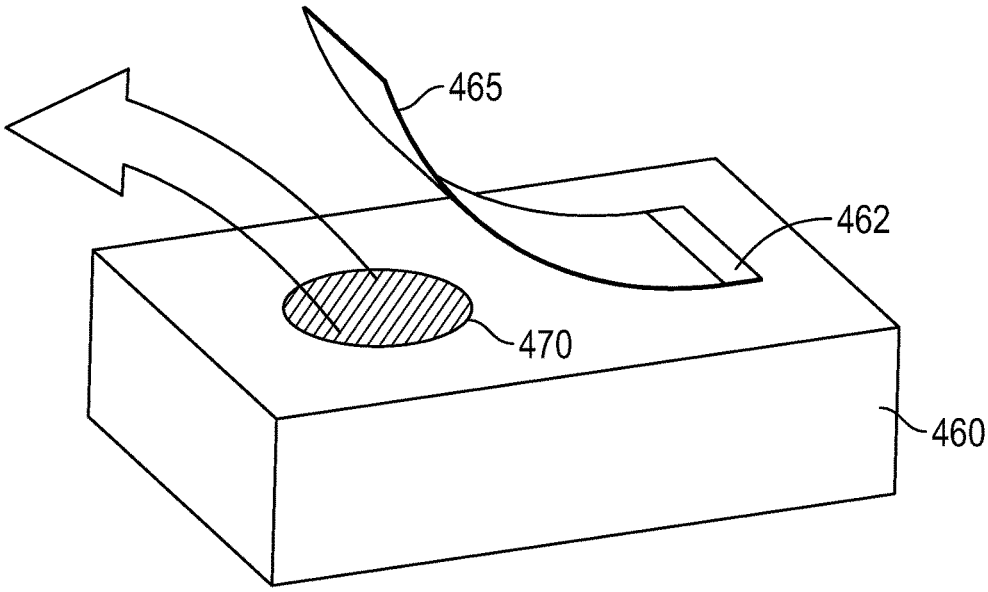
FIG. 4E shows how the moisture containing sachet can be used to maintain humidity in an enclosed space such as in a humidor.

In another embodiment, the valve can be used, as shown in FIG. 4E, to introduce humidity to an enclosed space, i.e. a cigar humidor. The pack 460 is placed in a humidor to regulate the humidity. The pack contains material which holds moisture, The pack 460 has a vent 470, covered by the valve 465, held to the pack by adhesive 462. When the humidity gets lower than the setpoint (e.g., 62%), the valve 465 curves as shown in FIG. 4D, opening the vent, so that moisture escapes from the material, thus humidifying the air in the enclosed space. Once the humidity rises to the set point of the valve, the valve will close. The moisture will be maintained to a minimum of the set point of the humidity control valve. In combination with a humidity control valve that is attached to a desiccant sachet, the humidity can be controlled in this way.

The valve being made of nylon and PET is a preferred embodiment, however, other materials can be used for the laminated film structure or humidity control valve body. The thickness of the two laminates can vary from thick to thin and in a range of proportions to meet the required application. A thicker nylon layer is able to generate more force on deflection but is slower to react to changes in humidity. The PET layer should be thick enough in proportion to the nylon to generate a bend in the finished laminate and not stretch or compress with changes in the nylon's dimensions. Thicker PET would create a narrower range of convex or concave deflections for a given range of humidity and generate a higher shear force at the laminate interface.

Rigid PVC could also be used as one of the materials. The rigidity can be adjusted by material thickness so a variety of materials will work. A good estimate would be a modulus of elasticity of 1.5 GPa (gigapascal) or higher.

Figure 6:
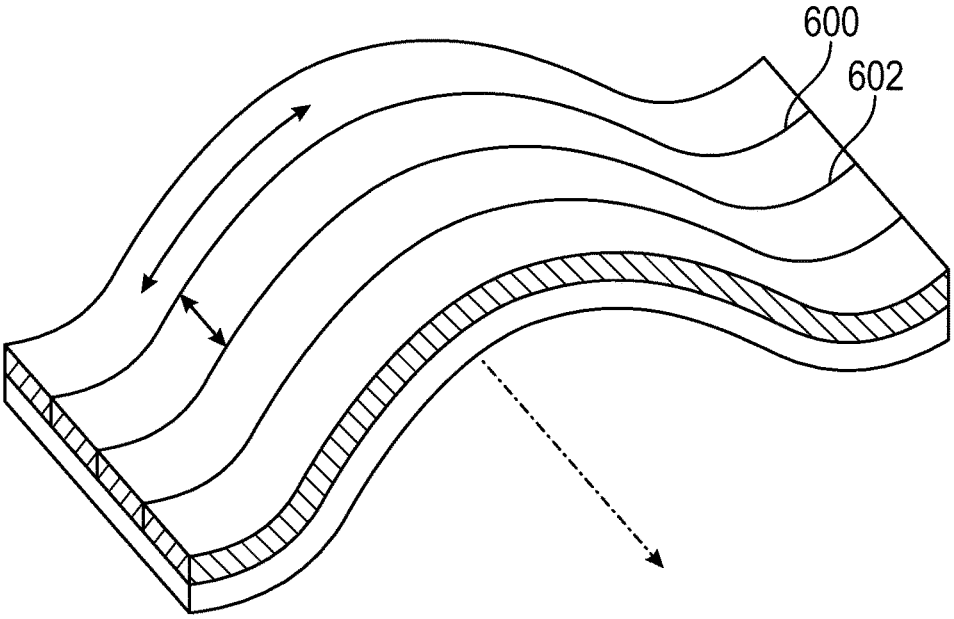
FIG. 6 shows will an embodiment where stress is reduced along the axis of curvature of the humidity control valve.

An efficient design of the laminate may include laser or mechanically etching the nylon or the PET to control or guide the axis of the curl, as shown in FIG. 6. This control can be guided by a linear pattern of parallel lines cut 600, 602 though one or both of the two layers (either or both of the nylon layer and/or the PET layer). The cuts relieve shear stress across the pattern and lessen the ability to curl at a right angle to that direction. The result provides a single axis of curl which would facilitate a better seal and opening to vent. Both ends of the laminated structure, where the lines terminate, are adhered permanently to the inside of the package in one embodiment to form anchor points to pull the barrier film to the PET layer and form a seal when concave, and push together to form a slack arc to open a vent path.

Figure 7A:
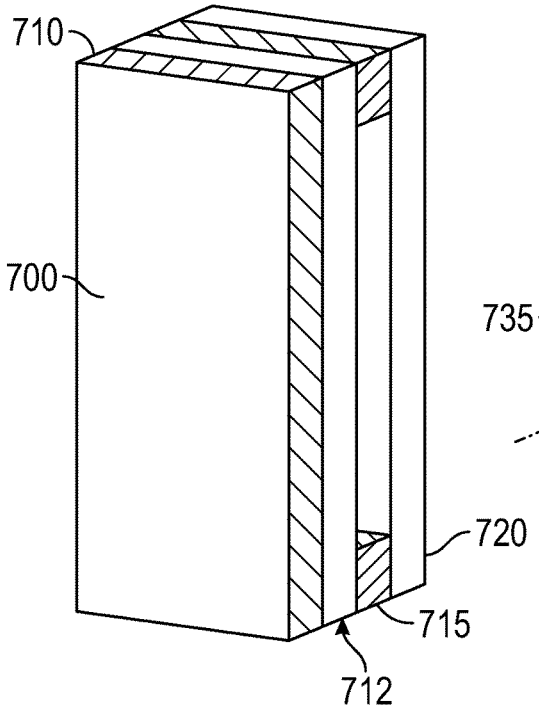
FIGS. 7*a* and 7B show the humidity control valve being attached to a package film.
Figure 7B:
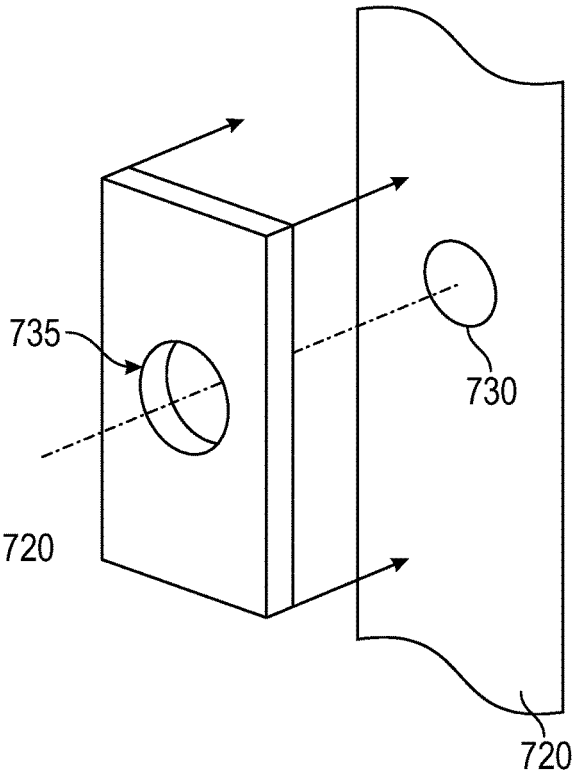

An alternate embodiment incorporates this sealing feature into an adhesive patch 700 as shown in FIGS. 7A-7B. The patch selectively covers a vent. The maximum vent opening is determined by the condition of the patch. The vent can also be restricted by the size of the perforation cut though the film of the package. The range of hole diameters or effective venting area are determined by the type and amount of produce contained in the package.

The patch 700 is shown in FIG. 7A. This can be formed by a layer of nylon 710 bonded to a PET layer 712, as in the other embodiments. This is bonded by adhesive 715 to the PET material of the package. Specific package venting would be determined by the smaller of the two areas, preferably created in the package itself and would be created by laser cutting or mechanical means. Ventilation in the package film could be a pattern of smaller holes that would block particles from entering or exiting the package. In that way a standard valve could generate a range of venting capacities.

FIG. 7B shows an exploded view of the the first layer (720) of patch with its maximum effective vent opening 735 over the smaller vent 730. In one embodiment, the patch could incorporate a film that is better suited to seal against including a low surface energy coating. Some applications may involve films that are hard to adhere to or would deform and make a seal difficult to achieve. The patch could also be designed to assure deflection during the active or convex state would create an opening and not deflect or curl in the same axis as the nylon PET structure which would prevent the proper opening.

The need for venting or absorbing excess humidity could result from several likely conditions. If the conditions occur and the humidity is allowed to form condensation, the result could be damage or total loss of the packaged product such as perishable food or produce. Such conditions include but are not limited to the following.

Moving the sealed package from a warm environment to a cool one or from cool to warm can cause condensation in the package. This would be common in transporting or storing packaged perishable foods. If condensation is allowed to form, water damage or microbiological growth could occur resulting in loss of shelf life.

Water vapor can be created by injured produce. A bruise or break in some produce may release more moisture into the sealed package than undamaged produce. This unexpected source of humidity could produce condensation and accelerate decay of the produce and generally shorten shelf life.

The respiration rate will increase for most produce if exposed to warmer temperatures. The higher respiration rates will produce more water vapor thus activating the humidity control valve which also allows the exchange of oxygen. In this case when the sealed package is exposed to higher temperatures than the package's OTR restriction was designed for, the humidity control valve will provide additional oxygen and prevent the produce from cellular damage due to hypoxic conditions.

Some other situations that can lead to condensation are localized within the package itself. One such situation is when the package is placed on a cold surface while being exposed to warmer air. When this happens, condensation can form on the cooler interior surface even though the average relative humidity of the package is below the set point of the valve.

Figure 9A:
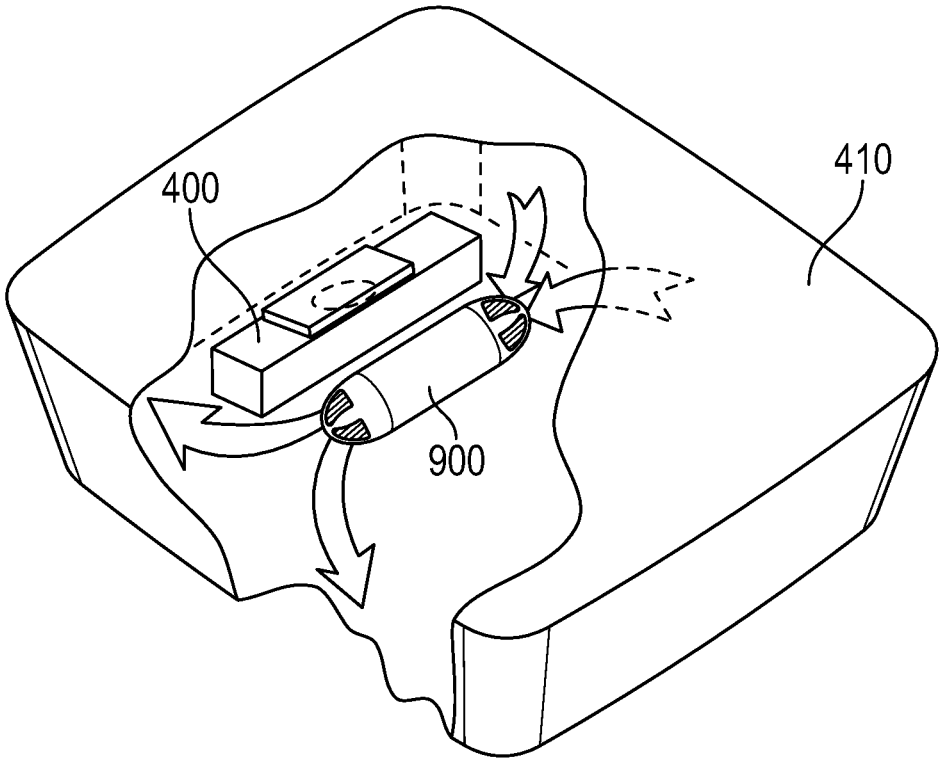
FIGS. 9A-9B shows an embodiment with a fan to circulate the air.

According to an embodiment, a low power air circulator can be used to maximize the effectiveness of the humidity control that is described herein. FIG. 9A shows the embodiment where a fan assembly 900 is added to the package of FIG. 4C. The fan assembly 900 is placed in the package, near the valved dessicant sachet. The fan uses a timed on-off cycle can be used to extend the battery life. The device in any case only needs to operate so long as the longest possible shelf life of the product. The fan, for example, can operate for 5 seconds during every 5 minute period.

Figure 9B:
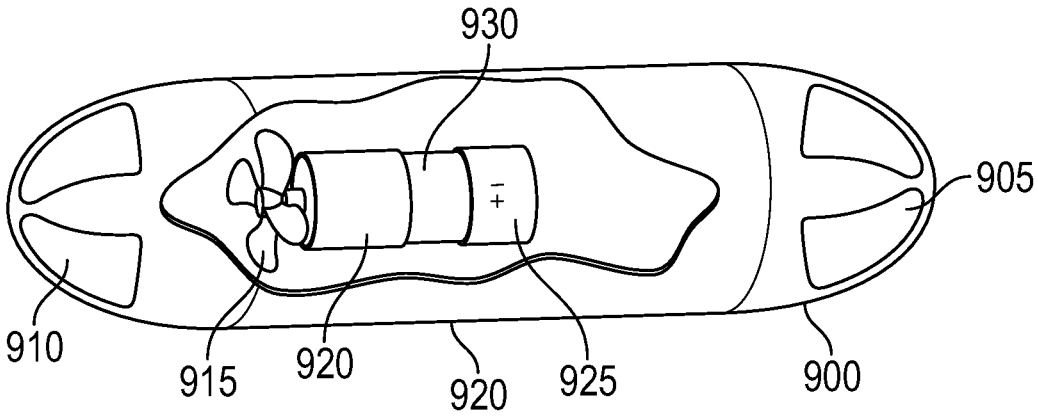

FIG. 9B illustrates further detail of the fan assembly 900. The fan assembly 900 includes air intake openings such as 905, and air outflow opening such as 910. The fan itself shown is 915 includes a blade that moves air through the housing 920 holding the fan assembly. The fan is driven by a motor 920, and powered by a battery 925 and timing circuit 930. As previously described, the timing circuit controls the motor to go on and off at specified intervals in order to maintain the fan life. In operation, the fan produces a very slow flow of air, in order to keep constant the airflow in the package.

Other embodiments are contemplated. For example, while the above embodiments have described a specific material, other materials could be included. Certain plastics which are laser transmissive, for example, can be used in place of the PE or PET described herein. Also, while these techniques can be used to protect coffee in a package, they can also be used to protect other materials in such a package.

Those of skill would further appreciate that these features can be carried out using different materials and different techniques different words and different shapes.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A humidity controlled package, comprising:

a package formed of a material with a set rate of gas transfer, said package defining an inner area which is sized to hold product, a humidity control valve, having an open state and a closed state, where in the open state, the humidity control valve opens an orifice to allow air flow between an inside of the valve and an outside of the valve, and in the closed state the valve closes the orifice to prevent air flow between the inside and outside of the valve, a sachet of desiccant that absorbs moisture, and where the humidity control valve separates the inner area of the package from the desiccant in the sachet, the sachet has an opening that is covered by the humidity control valve, and where the humidity control valve closes the opening when humidity in the package is below the set point, and opens the opening when humidity in the package is above the set point, where the humidity control valve is located in the package, and where the valve is automatically opened to open the orifice, and closed to close the orifice by a humidity level inside the package mechanically changing the shape of the valve, where said humidity control value is configured to change humidity in the inner area of the package when the valve is opened by exposing the dessicant to the inside of the package, and to maintain humidity in the inner area of the package as unchanged when the valve is not opened, where the valve is formed of a two part structure including a first material that swells when its moisture is increased, and a second material that does not swell with moisture, and the valve is caused to change shape by bending in a first direction when its humidity is above a set point, and bending in a second opposite direction when the humidity is below the set point.

2. The package as in claim 1, further comprising a fan in the package, that turns on and off to circulate air in the package.

3. The package as in claim 1, wherein the humidity control valve curves along an axis, and the valve has lines cut therein through a part of the humidity control valve to guide the curving of the valve.

4. The package as in claim 1, wherein said first material is nylon.

5. The package as in claim 4, wherein said second material is PET.

6. A humidity controlled package, comprising:

a package formed of a material with a set rate of gas transfer, said package defining an inner area which is sized to hold product, a humidity control valve, having an open state and a closed state, where in the open state, the humidity control valve opens an orifice to allow air flow between an inside of the valve and an outside of the valve, and in the closed state the valve closes the orifice to prevent air flow between the inside and outside of the valve, where the humidity control valve is located at least partly in the package, and where the valve is automatically opened to open the orifice, and closed to close the orifice by a humidity level inside the package mechanically changing the shape of the valve, where said humidity control value is configured to change humidity in the inner area of the package when the valve is opened, and to maintain humidity in the inner area of the package as unchanged when the valve is not opened, where the valve is formed of a two part structure including a first material that swells when its moisture is increased, and a second material that does not swell with moisture, and the valve is caused to change shape by bending in a first direction when its humidity is above a set point, and bending in a second opposite direction when the humidity is below the set point, further comprising a pack of moisture containing material that regulates humidity, where the humidity control valve separates air in the package from the moisture containing material in the pack, and the pack has an opening that is covered by the humidity control valve, and where the humidity control valve opens the opening when humidity in the package is below the set point and closes the opening when humidity in the package is above the set point.

7. The package as in claim 6, wherein said first material is nylon.

8. The package as in claim 7, wherein said second material is PET.

* * * * *